US011565864B2

(12) United States Patent
Fuhst

(10) Patent No.: US 11,565,864 B2
(45) Date of Patent: Jan. 31, 2023

(54) PERFORATED CASE PACK TOP PANEL

(71) Applicant: Niagara Bottling, LLC, Diamond Bar, CA (US)

(72) Inventor: Jason Thomas Fuhst, Diamond Bar, CA (US)

(73) Assignee: Niagara Bottling, LLC, Diamond Bar, CA (US)

( * ) Notice: Subject to any disclaimer, the term of this patent is extended or adjusted under 35 U.S.C. 154(b) by 0 days.

(21) Appl. No.: 16/918,849

(22) Filed: Jul. 1, 2020

(65) Prior Publication Data

US 2020/0331681 A1 Oct. 22, 2020

Related U.S. Application Data

(63) Continuation-in-part of application No. 16/542,195, filed on Aug. 15, 2019, now abandoned.

(60) Provisional application No. 62/719,517, filed on Aug. 17, 2018.

(51) Int. Cl.

| | |
|---|---|
| ***B65D 75/58*** | (2006.01) |
| ***B65B 61/00*** | (2006.01) |
| ***B65D 71/08*** | (2006.01) |

(52) U.S. Cl.

CPC ..... *B65D 75/5838* (2013.01); *B65B 61/007* (2013.01); *B65D 71/08* (2013.01)

(58) Field of Classification Search

CPC ..... B65D 75/5838; B65D 71/08; B65D 75/5833; B65D 75/5827; B65D 75/002

USPC ..... 206/432, 427

See application file for complete search history.

(56) References Cited

U.S. PATENT DOCUMENTS

| | | | |
|---|---|---|---|
| 2,554,841 | A | 5/1951 | Rumsey, Jr. |
| 3,231,083 | A | 1/1966 | Rumsey, Jr. |
| 3,338,404 | A | 8/1967 | Becker et al. |
| 3,396,841 | A | 8/1968 | Copping |

(Continued)

FOREIGN PATENT DOCUMENTS

| | | | |
|---|---|---|---|
| EP | 696542 | A1 | 2/1996 |
| EP | 1785357 | A1 | 5/2007 |

(Continued)

OTHER PUBLICATIONS

International Search Report with Written Opinion for related Application No. PCT/US2019/046857 dated Nov. 5, 2019 (9 Pages).

(Continued)

*Primary Examiner* — Steven A. Reynolds

(74) *Attorney, Agent, or Firm* — Michael Best & Friedrich LLP

(57) ABSTRACT

An apparatus and a method are provided for a perforated top panel disposed in a shrink-wrapped bottle pack for containing water bottles. The perforated top panel includes an easy-open panel and a semi-circular portion disposed at a terminal end of the easy-open panel. The easy-open panel is partially bordered by an alternating series of cuts and lands that are configured to allow the easy-open panel to tear away from the top panel upon being pulled by a practitioner. The easy-open panel includes a parallel portion that extends to one or more tapered portions that terminate at the semi-circular portion. The semi-circular portion is configured to be grasped and pulled to separate the tapered portion and the parallel portion from the top panel and thus expose the water bottles.

19 Claims, 4 Drawing Sheets

(56) References Cited

U.S. PATENT DOCUMENTS

| | | | | |
|---|---|---|---|---|
| 3,442,436 | A | 5/1969 | Kirby, Jr. | |
| 3,747,749 | A | 7/1973 | Brown | |
| 3,764,351 | A | 10/1973 | Whittington et al. | |
| 4,078,659 | A | 3/1978 | Rensner | |
| 4,333,570 | A * | 6/1982 | Heider | B65D 71/10 206/432 |
| 4,586,312 | A | 5/1986 | Limousin | |
| 4,871,068 | A | 10/1989 | Dreyfus | |
| 5,036,978 | A | 8/1991 | Frank et al. | |
| 5,048,687 | A * | 9/1991 | Suzuki | B65D 75/5833 206/497 |
| 5,050,742 | A | 9/1991 | Muckenfuhs | |
| 5,067,612 | A | 11/1991 | Tsuchiya et al. | |
| 5,129,518 | A | 7/1992 | Tanaka et al. | |
| 5,160,030 | A | 11/1992 | Binsfeld | |
| 5,219,229 | A | 6/1993 | Sengewald | |
| 5,666,445 | A | 9/1997 | Conrad et al. | |
| 5,771,662 | A | 6/1998 | Struges et al. | |
| 6,105,776 | A * | 8/2000 | Meilhon | B65D 75/5844 206/497 |
| 6,145,656 | A | 11/2000 | Marco | |
| 6,213,293 | B1 | 4/2001 | Marco | |
| 6,513,657 | B2 | 2/2003 | Sheehan, Jr. | |
| 6,698,928 | B2 | 3/2004 | Miller | |
| 6,935,491 | B2 | 8/2005 | Marco | |
| 7,878,328 | B2 | 2/2011 | Dubosq et al. | |
| 7,942,263 | B2 | 5/2011 | Block | |
| 8,002,114 | B2 | 8/2011 | Faber | |
| 8,104,617 | B2 | 1/2012 | Goto et al. | |
| 8,127,925 | B2 | 3/2012 | Block | |
| 8,333,054 | B2 | 12/2012 | Hartl | |
| 8,800,770 | B2 | 8/2014 | Percival et al. | |
| 9,090,389 | B2 | 7/2015 | Kettwig et al. | |
| 9,511,885 | B2 | 12/2016 | Stuhlmann | |
| 9,561,889 | B2 | 2/2017 | Dayrit et al. | |
| 9,776,780 | B2 | 10/2017 | Schloesser et al. | |
| 10,144,567 | B2 | 12/2018 | Schloesser et al. | |
| 10,189,621 | B2 | 1/2019 | Dayrit et al. | |
| 10,202,229 | B2 | 2/2019 | Huerta et al. | |
| 10,259,630 | B2 | 4/2019 | Gatteschi | |
| 10,259,631 | B2 | 4/2019 | Zillges | |
| 10,781,022 | B2 | 9/2020 | Huerta et al. | |
| 2002/0112982 | A1 | 8/2002 | Stagray et al. | |
| 2002/0157980 | A1 | 10/2002 | Sheehan | |
| 2002/0162766 | A1 | 11/2002 | Saso et al. | |
| 2007/0095697 | A1 | 5/2007 | Auclair et al. | |
| 2008/0302692 | A1 | 12/2008 | Dubosq et al. | |
| 2011/0215016 | A1 | 9/2011 | Block | |
| 2014/0096486 | A1 | 4/2014 | Buchkremer et al. | |
| 2014/0231493 | A1 | 8/2014 | Andersen et al. | |
| 2015/0197384 | A1 | 7/2015 | Schloesser et al. | |
| 2016/0130059 | A1 | 5/2016 | Andersen et al. | |
| 2016/0264331 | A1 | 9/2016 | Gatteschi | |
| 2017/0066580 | A1 | 3/2017 | Howells et al. | |
| 2018/0065788 | A1 | 3/2018 | Branyon | |

FOREIGN PATENT DOCUMENTS

| | | | |
|---|---|---|---|
| EP | 2730515 | B1 | 8/2016 |
| JP | 2015217954 | A | 12/2015 |
| WO | WO2019060630 | A1 | 3/2019 |

OTHER PUBLICATIONS

International Search Report with Written Opinion for related Application No. PCT/US2021/040174 dated Sep. 30, 2021 (7 Pages).

* cited by examiner

FIG. 1
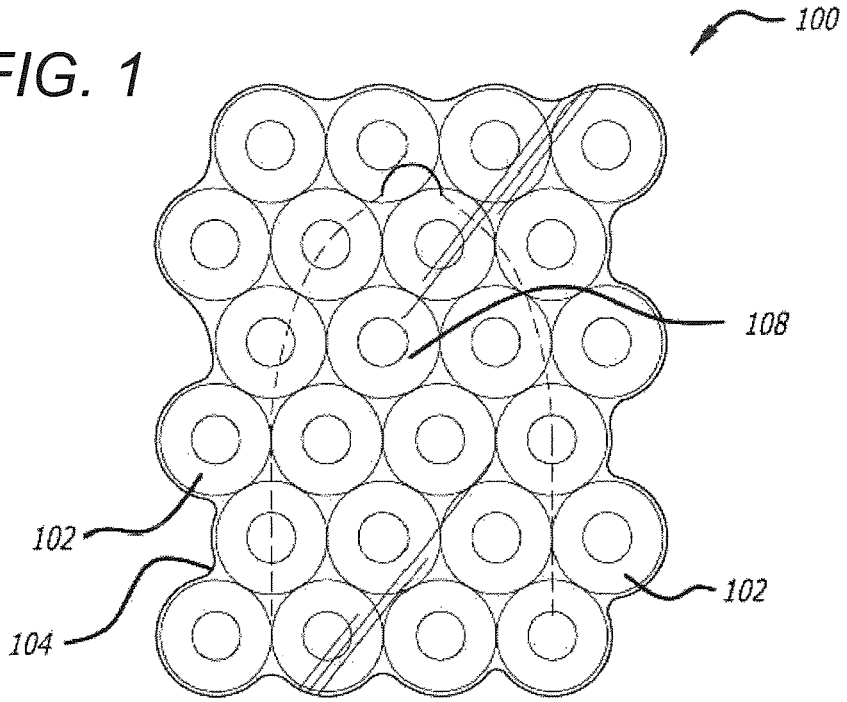
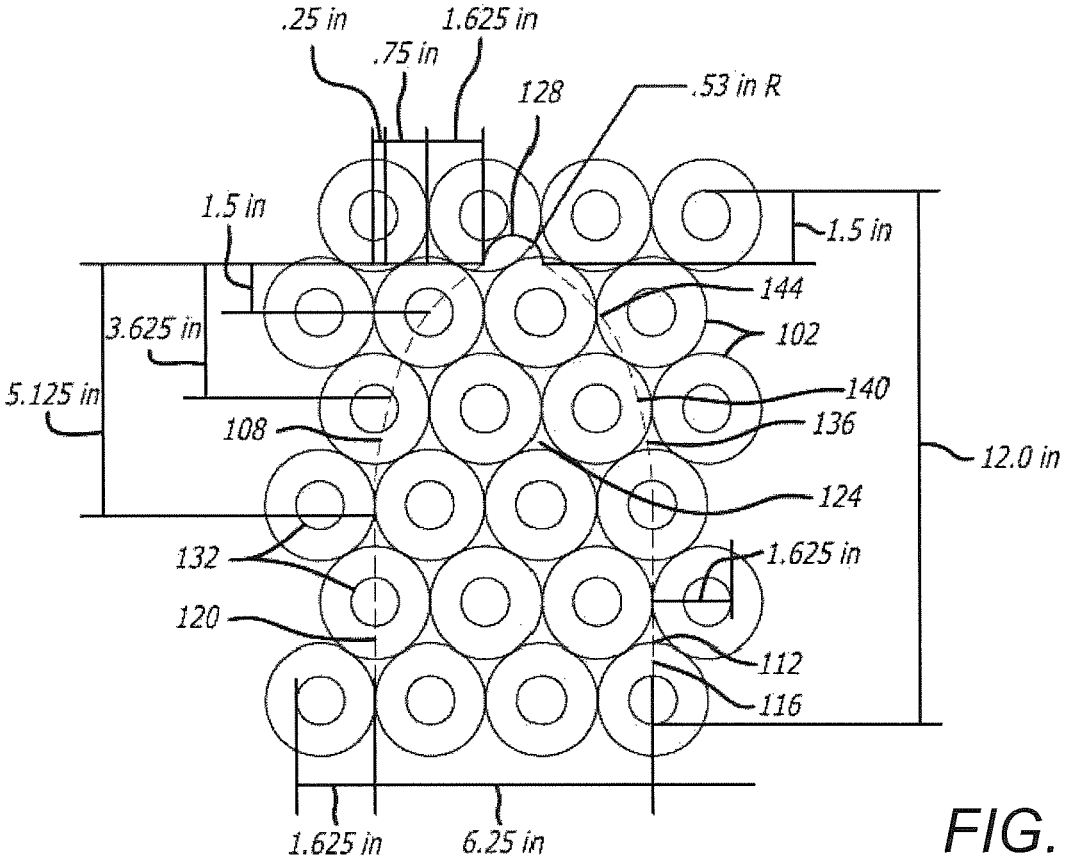
FIG. 2

FIG. 3
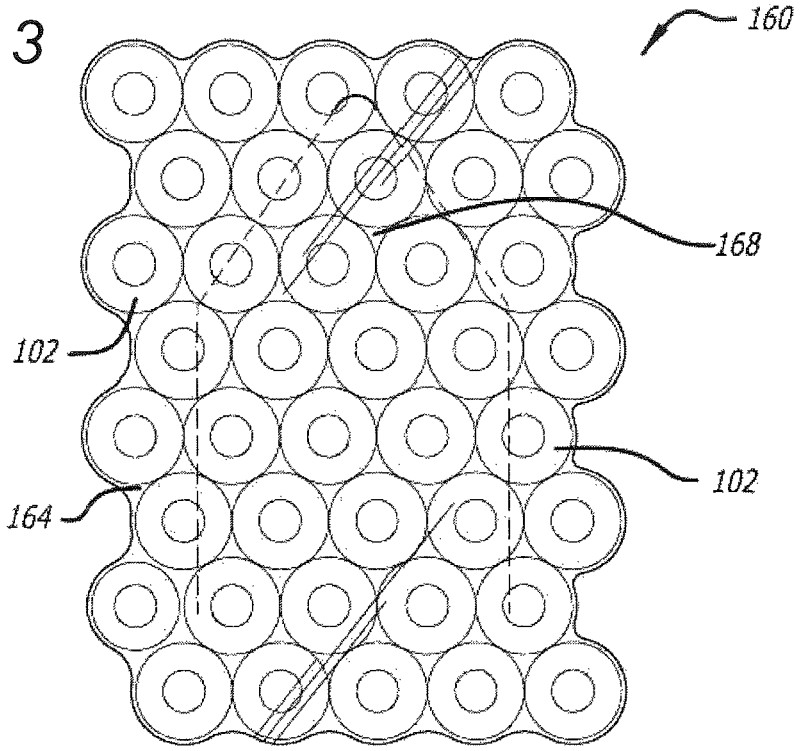
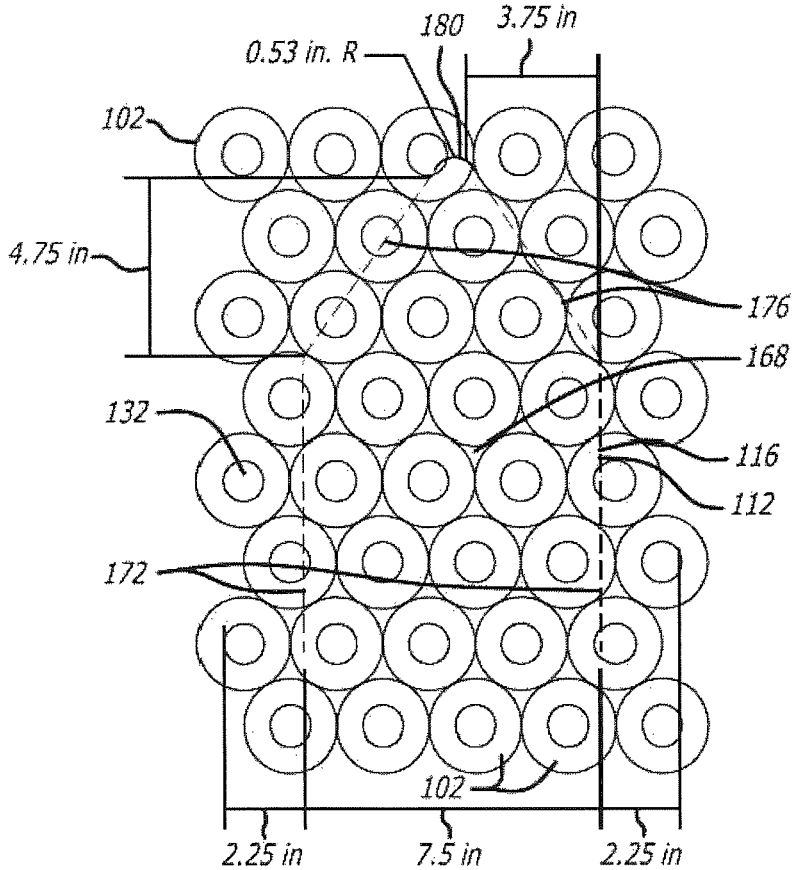
FIG. 4

FIG. 5
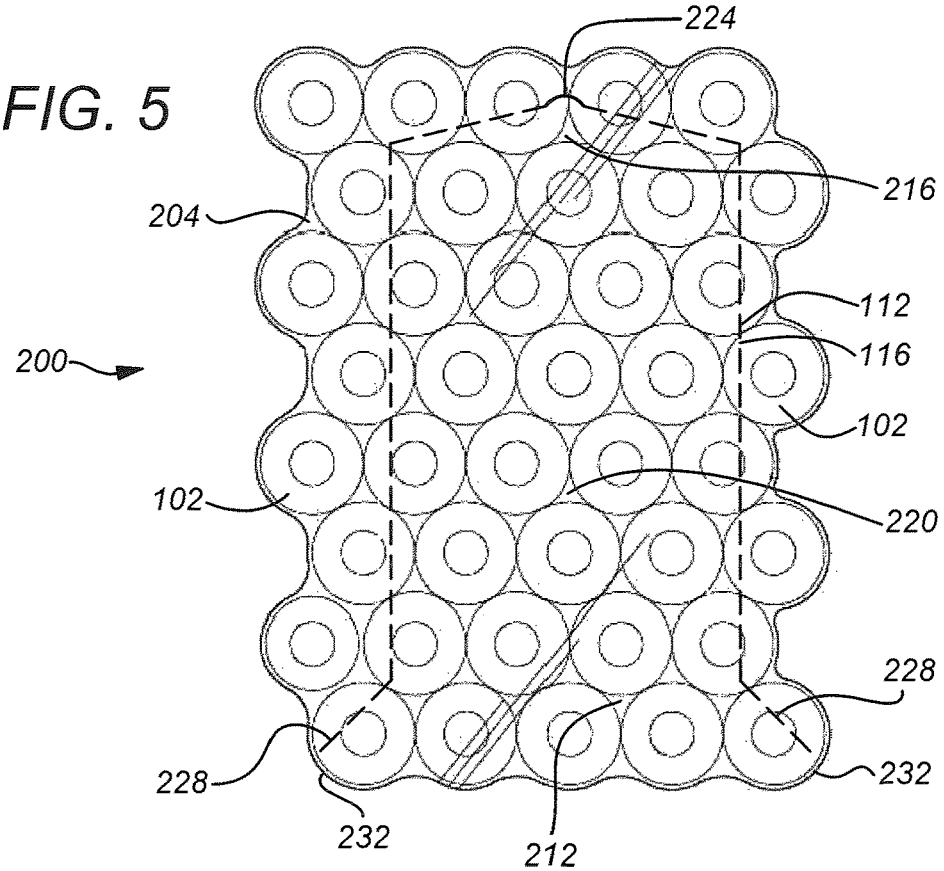
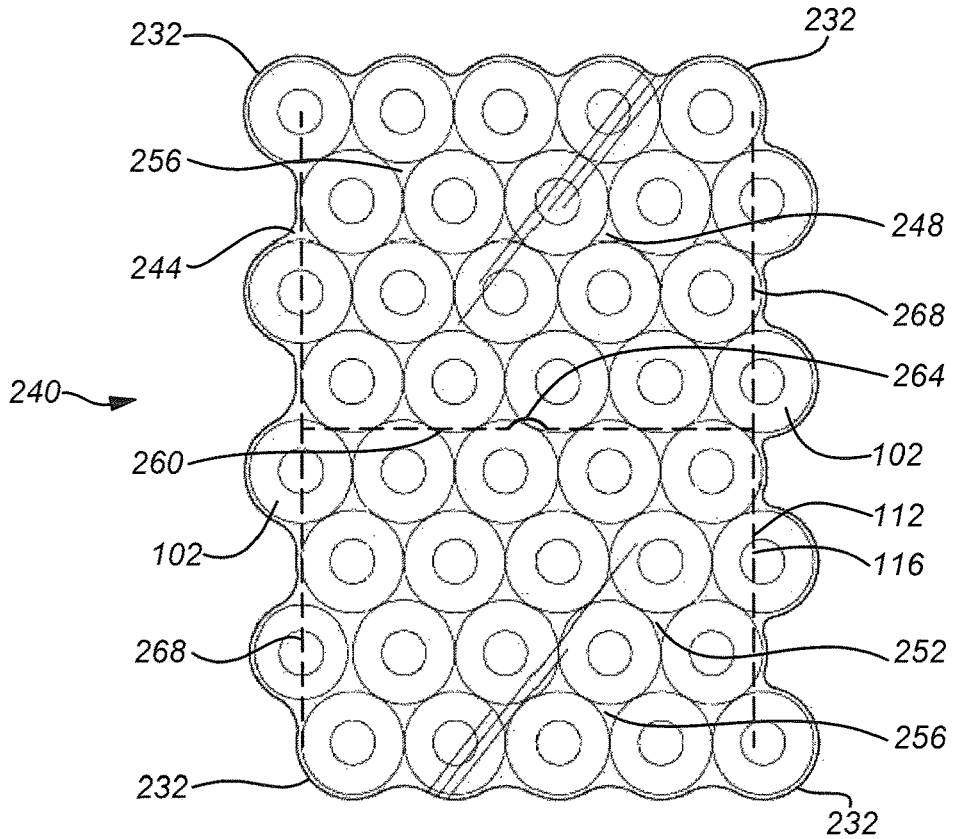
FIG. 6

PERFORATED CASE PACK TOP PANEL

PRIORITY

This application is a continuation in part of, and claims the benefit of, U.S. Patent Application, entitled "Perforated Case Pack Top Panel," filed on Aug. 15, 2019, and having application Ser. No. 16/542,195, which claims the benefit of, and priority to, U.S. Provisional Application, entitled "Perforated Case Pack Top Panel," filed on Aug. 17, 2018 and having application Ser. No. 62/719,517, the entirety of each of said applications being incorporated herein by reference.

FIELD

Embodiments of the present disclosure generally relate to the field of collation shrink films. More specifically, embodiments of the disclosure relate to a perforated top panel of a shrink-wrapped bottle pack.

BACKGROUND

Collation shrink films are films that are wrapped around one or more objects to be packaged and shrunk to keep the objects together. The most common use of these films is in the packaging of multiple containers, such as bottles containing beverages, food, and the like. The wrapping process generally involves a shrink oven or a shrink tunnel wherein the film and the containers covered by the film are briefly heated to cause the shrink-wrapping to occur. The plastic film then collapses around the containers and holds the units in place.

Films that are used as collation shrink films generally possess properties that make them commercially feasible. For example, films much exhibit good shrinkage, as well as possess excellent strength after shrinkage, referred to as load retention resistance. Further, films must resist puncture and must not be sticky so as to inhibit the film sticking to the packaged containers. Further, in some instances, the collation shrink films are cut during the wrapping process so amenability to cutting is important.

Sealing properties are also important. In some cases, during the wrapping process, the two sides of the film are passed around the object being wrapped and are contacted, typically underneath the product being wrapped. These two film edges must be sealed, and the seal strength needs to be high. Since the whole packaged ensemble is often carried simply by grabbing hold of the packaging film, the seal strength must ideally be strong enough to hold the weight of the packaged containers.

SUMMARY

Systems and methods for application identification in accordance with embodiments of the invention are disclosed. In one embodiment, a perforated top panel is disposed in a shrink-wrapped bottle pack for containing water bottles, the perforated top panel including an easy-open panel, and a semi-circular portion disposed at a terminal end of the easy-open panel.

In a further embodiment, the easy-open panel is partially bordered by an alternating series of cuts and lands.

In another embodiment, the alternating series of cuts and lands are configured to allow the easy-open panel to tear away from the top panel upon being pulled by a practitioner.

In a still further embodiment, each of the cuts has a length of substantially 0.125 inches and each of the lands has a length of substantially 0.250 inches.

In still another embodiment, each of the lands has a length ranging between substantially 0.250 inches and substantially 0.375 inches.

In yet another embodiment, each of the cuts has a length of substantially 0.125 inches and each of the lands has a length of substantially 0.3125 inches.

In a further embodiment again, the easy-open panel includes a parallel portion that extends to a tapered portion that terminates at the semi-circular portion.

In another embodiment again, the parallel portion has a width of 7.5 inches and is disposed substantially 2.25 inches from opposite sides of the bottle pack.

In a further additional embodiment, the semi-circular portion is configured to be grasped and pulled to separate the tapered portion and the parallel portion from the top panel and thus expose the water bottles.

In another additional embodiment, the tapered portion begins at a distance of about 4.75 inches from the semi-circular portion, opposite sides of the tapered portion each approaching the midline of the easy-open panel by a distance of substantially 3.75 inches before terminating at the semi-circular portion.

In a still yet further embodiment, the tapered portion includes one or more portions that are increasingly tapered toward the semi-circular portion.

In still yet another embodiment, the tapered portion includes a first tapered portion that beings at about 5.125 inches from the semi-circular portion, each of the opposite sides of the first tapered portion narrowing by substantially 0.25 inches.

In a still further embodiment again, the first tapered portion transitions to a second tapered portion at about 3.625 inches from the semi-circular portion, opposite sides of the second tapered portion each narrowing by about 0.75 inches.

In still another embodiment again, the second tapered portion transitions to a third tapered portion at about 1.5 inches from the semi-circular portion, opposite sides of the third tapered portion narrowing by about 1.625 inches before terminating at the semi-circular portion.

In a still further additional embodiment, the semi-circular portion includes a cutout portion of the top panel having a radius of substantially 0.53 inches and being disposed roughly 1.5 inches from a side portion of the bottle pack.

In still another additional embodiment, the semi-circular portion is centrally disposed along a midline of the easy-open panel.

In a yet further embodiment again, the parallel portion is bordered on opposite sides by parallel perforations.

In yet another embodiment again, the parallel portion has a width and a length suitable to allow access to the water bottles once the easy-open panel is torn open.

In a yet further additional embodiment, the parallel portion has a width of 6.25 inches and is disposed substantially 1.625 inches from opposite sides of the shrink-wrapped bottle pack.

In yet another additional embodiment, the length of the parallel portion extends substantially 12 inches from the side of the bottle pack nearest the semi-circular portion.

In many embodiments, a method for a perforated top panel disposed in a shrink-wrapped bottle pack containing water bottles includes shrink-wrapping a multiplicity of water bottles to form a pack of the water bottles, perforating an easy-open panel in a top panel including the shrink-wrapped bottle pack, and forming a semi-circular portion at a terminal end of the easy-open panel.

In a further additional embodiment again, forming the semi-circular portion includes cutting the semi-circular portion into the shrink-wrapping by way of a blade or a laser coder.

In another additional embodiment again, perforating includes forming cuts in the shrink-wrapping by way of a blade or a laser coder.

In a still yet further embodiment again, forming includes forming 0.125 inch-long cuts in the shrink-wrapping, adjacent cuts being separated by lands ranging between substantially 0.250 inches and substantially 0.375 inches.

In still yet another embodiment again, perforating includes including a parallel portion and a tapered portion including the easy-open panel, the tapered portion terminating at the semi-circular portion.

In an exemplary embodiment, a perforated top panel disposed in a shrink-wrapped bottle pack comprises: an easy-open panel; and an alternating series of cuts and lands bordering a portion of the easy-open panel.

In another exemplary embodiment, the easy-open panel includes a first tapered portion and a second tapered portion that share an intervening parallel portion. In another exemplary embodiment, the parallel portion extends from the second tapered portion to the first tapered portion. In another exemplary embodiment, the tapered portion terminates at a semi-circular portion configured to facilitate grasping the first tapered portion to open easy-open panel. In another exemplary embodiment, the parallel portion is bordered on opposite sides by parallel perforations. In another exemplary embodiment, the parallel portion has a width and a length suitable to expose a majority of bottles comprising the shrink-wrapped bottle pack. In another exemplary embodiment, the length of the parallel portion extends across a majority of the perforated top panel.

In another exemplary embodiment, the first tapered portion includes sides that extend from the parallel portion and approach a midline of the easy-open panel. In another exemplary embodiment, the first tapered portion includes one or more portions that are increasingly tapered toward the midline of the easy-open panel. In another exemplary embodiment, the second tapered portion includes sides that extend to opposite corners of the shrink-wrapped bottle pack. In another exemplary embodiment, the second tapered portion includes one or more portions that are increasingly tapered toward the opposite corners of the shrink-wrapped bottle pack.

In another exemplary embodiment, the easy-open panel includes a first parallel portion and a second parallel portion that share a central perforation line that is aligned along a midline of the shrink-wrapped bottle pack. In another exemplary embodiment, a semi-circular portion is disposed at a midpoint of the central perforation line and configured to facilitate separating the first parallel portion and the second parallel portion along the central perforation line. In another exemplary embodiment, the first parallel portion and the second parallel portion are bordered on opposite sides by parallel side perforation lines. In another exemplary embodiment, the side perforation lines are disposed along the sides of the shrink-wrapped bottle pack. In another exemplary embodiment, the first parallel portion and the second parallel portion have a width and a length that to expose a majority of bottles comprising the shrink-wrapped bottle pack.

In an exemplary embodiment, a method for a perforated top panel disposed in a shrink-wrapped bottle pack comprises: shrink-wrapping a multiplicity of bottles; configuring an easy-open panel in a top panel comprising the shrink-wrapped bottle pack; and perforating the easy-open panel into the top panel.

In another exemplary embodiment, configuring includes forming a first tapered portion and a second tapered portion that share an intervening parallel portion. In another exemplary embodiment, configuring includes forming a first parallel portion and a second parallel portion that share a central perforation line aligned along a midline of the shrink-wrapped bottle pack.

BRIEF DESCRIPTION OF THE DRAWINGS

The drawings refer to embodiments of the present disclosure in which:

FIG. 1 illustrates a top view of an exemplary embodiment of a shrink-wrapped bottle pack that includes a perforated top panel according to the present disclosure;

FIG. 2 illustrates a top plan view of the shrink-wrapped bottle pack of FIG. 1;

FIG. 3 illustrates a top view of an exemplary embodiment of a shrink-wrapped bottle pack that includes a perforated top panel according to the present disclosure;

FIG. 4 illustrates a top plan view of the shrink-wrapped case pack of FIG. 3;

FIG. 5 illustrates a top plan view of an exemplary embodiment of a shrink-wrapped bottle pack that comprises a multiplicity of bottles and includes a perforated top panel according to the present disclosure;

FIG. 6 illustrates a top plan view an exemplary embodiment of a shrink-wrapped bottle pack that comprises a multiplicity of bottles and includes a perforated top panel, in accordance with the present disclosure;

Figure 7:
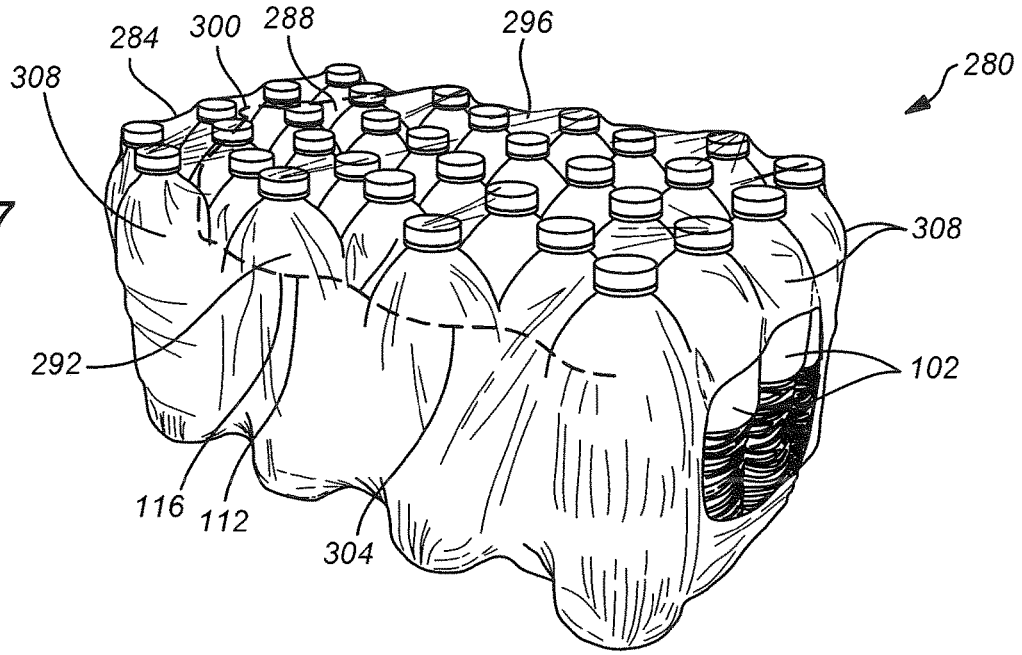
FIG. 7 illustrates a perspective view of an exemplary embodiment of a shrink-wrapped bottle pack that includes a perforated top panel that extends to shoulder portions of the bottles according to the present disclosure.

While the present disclosure is subject to various modifications and alternative foil is, specific embodiments thereof have been shown by way of example in the drawings and will herein be described in detail. The invention should be understood to not be limited to the particular forms disclosed, but on the contrary, the intention is to cover all modifications, equivalents, and alternatives falling within the spirit and scope of the present disclosure.

DETAILED DESCRIPTION

A drawback to conventional collation shrink films, however, is they are often strong enough to hinder a consumer opening shrink-wrapped packages. A knife or scissors generally are required to cut open the shrink-wrapped package. In absence of such a tool, the consumer is left with pulling, ripping and tearing at the film to access the containers within the package. Embodiment presented herein correct these drawbacks and provide consumers with shrink-wrapped beverage packages that are easy to open without falling apart beforehand.

In the following description, numerous specific details are set forth in order to provide a thorough understanding of the present disclosure. It will be apparent, however, to one of ordinary skill in the art that the invention disclosed herein may be practiced without these specific details. In other instances, specific numeric references such as "first panel," may be made. However, the specific numeric reference should not be interpreted as a literal sequential order but rather interpreted that the "first panel" is different from a "second panel." Thus, the specific details set forth are merely exemplary. The specific details may be varied from and still be contemplated to be within the spirit and scope of the present disclosure. The term "coupled" is defined as meaning connected either directly to the component or indirectly to the component through another component. Further, as used herein, the terms "about," "approximately," or "substantially" for any numerical values or ranges indicate a suitable dimensional tolerance that allows the part or collection of components to function for its intended purpose as described herein.

In general, the present disclosure provides a perforated pattern disposed on a top panel of a shrink-wrapped bottle pack configured to provide an easy-open feature for consumers. The perforated pattern may be applied after the bottle pack is shrink-wrapped. Further, the perforated pattern may be formed by way of various blades, or by way of one or more laser coders.

Both the perforation pattern and the shape of the easy-open panel are critical to the functionality of the perforated pattern. If the perforations, or "cuts," or the distance between the cuts, called "lands," is too large, the ease of opening may be adversely influenced. For example, if the perforation pattern is too aggressive there is risk that the easy-open feature may operate prematurely, whereas if the perforation pattern is too conservative the feature may be difficult to open and result in jagged edges on the film. The shape of the easy-open panel also is crucial to performance. Experimentation has demonstrated that a tapered configuration generally provides optimal results, as shown and described herein.

Turning specifically to the drawings, FIG. 1 illustrates a top view of an exemplary embodiment of a shrink-wrapped bottle pack 100 that comprises 24 bottles 102 and includes a perforated top panel 104 according to the present disclosure. The bottles 102 may be of a variety typically used for storing liquid contents, such as water, juice, carbonated contents, and the like. FIG. 2 illustrates a top plan view of the bottle pack 100 of FIG. 1 in absence of the shrink-wrapped film. The perforated top panel 104 comprises an easy-open panel 108 that is partially bordered by an alternating series of cuts 112 and lands 116. The series of cuts 112 and lands 116 is configured to allow the easy-open panel 108 to tear away from the top panel 104 upon being pulled by a practitioner. In the illustrated embodiment of FIGS. 1-2, each of the cuts 112 has a length of substantially 0.125 inches and each of the lands 116 has a length of substantially 0.250 inches. In some embodiments, however, each of the lands may range between substantially 0.250 inches and substantially 0.375 inches, without limitation.

With continuing reference to FIGS. 1-2, the easy-open panel 108 comprises a parallel portion 120 that extends to a tapered portion 124, which in turn terminates at a semi-circular portion 128. It is contemplated that a practitioner desiring access to the bottles 102 may grasp the semi-circular portion 128 and pull to separate the tapered portion 124 and the parallel portion 120 from the top panel 104 and thus expose the bottles 102. In an embodiment, the semi-circular portion 128 comprises a cutout portion of the top panel 104 having a radius of substantially 0.53 inches and being disposed roughly 1.5 inches from a side portion of the bottle pack 100. As will be appreciated, the semi-circular portion 128 preferably is centrally disposed along a midline of the easy-open panel 108.

The parallel portion 120 is bordered on opposite sides by parallel perforations (i.e., the cuts 112 and lands 116), as shown in FIG. 2. The parallel portion 120 generally has a width and a length suitable to allow a practitioner to access the bottles 102 once the easy-open panel 108 is torn open, as described above. In the illustrated embodiment of FIG. 2, the parallel portion 120 has a width of 6.25 inches and is disposed substantially 1.625 inches from opposite sides of the bottle pack 100. Further, the length of the parallel portion 120 extends substantially 12 inches from the side of the bottle pack 100 nearest the semi-circular portion 128. Upon inspection of FIG. 2, it should be understood that the sides of the bottle pack 100 are defined by the edges of bottle caps 132, or closures, that are coupled with the tops of the bottles 102.

As mentioned hereinabove, the parallel portion 120 extends of a tapered portion 124 that terminates at the semi-circular portion 128. It is contemplated, however, that the tapered portion 124 may include one or more portions that are increasingly tapered toward the semi-circular portion 128. For example, in the illustrated embodiment of FIG. 2, the tapered portion 124 comprises a first tapered portion 136 that beings at about 5.125 inches from the semi-circular portion 128. The first tapered portion 136 transitions to a second tapered portion 140 at about 3.625 inches from the semi-circular portion 128. Continuing, at about 1.5 inches from the semi-circular portion 128, the second tapered portion 140 transitions to a third tapered portion 144 that terminates at the semi-circular portion 128.

As will be recognized, opposite sides of the first, second, and third tapered portions 136, 140, 144 approach the midline of the easy-open panel 108 with increasing degrees of taper. As shown in FIG. 2, each of the opposite sides of the first tapered portion 136 taper, or narrow, by substantially 0.25 inches. The opposite sides of the second tapered portion 140 each narrow by about 0.75 inches and each of the opposite sides of the third tapered portion 144 narrow by roughly 1.625 inches before terminating at the semi-circular portion 128. It should be understood, however, that more than or less than three tapered portions may be incorporated into other embodiments of the tapered portion 124, without limitation.

FIGS. 3-4 illustrate an exemplary embodiment of a shrink-wrapped bottle pack 160 that comprises 40 bottles 102 and includes a perforated top panel 164 according to the present disclosure. As mentioned with respect to FIG. 1, the bottles 102 may be of a variety typically used for storing liquid contents, such as water, juice, carbonated contents, and the like. The perforated top panel 164 is substantially similar to the perforated top panel 104 of FIGS. 1-2, with the exception that the perforated top panel 164 includes a size and shape advantageously configured to allow a practitioner to easily access the 40 bottles 102.

The perforated top panel 164 comprises an easy-open panel 168 that is partially bordered by an alternating series of cuts 112 and lands 116. The series of cuts 112 and lands 116 are configured to allow the easy-open panel 168 to tear away from the top panel 164 upon being pulled by a practitioner. In the illustrated embodiment of FIGS. 3-4, each of the cuts 112 has a length of substantially 0.125 inches, and each of the lands 116 has a length of substantially 0.3125 inches. As mentioned hereinabove, however, in some embodiments, each of the lands 116 may range between substantially 0.250 inches and substantially 0.375 inches, without limitation.

The easy-open panel 168 comprises a parallel portion 172 that extends to a tapered portion 176 that terminates at a semi-circular portion 180. As will be appreciated, a practitioner desiring access to the bottles 102 may grasp the semi-circular portion 180 and pull to separate the tapered portion 176 and the parallel portion 172 from the top panel 164 to expose the bottles 102. The semi-circular portion 180 is substantially similar to the semi-circular portion 128 and thus comprises a cutout portion of the top panel 164 having a radius of substantially 0.53 inches. Further, the semi-circular portion 180 may be disposed roughly 1.5 inches from a side portion of the bottle pack 160 and is centrally disposed along a midline of the easy-open panel 168.

The parallel portion 172 is bordered on opposite sides by parallel perforations, as shown in FIG. 4. The parallel portion 172 has a width and a length suitable to allow a practitioner to access the bottles 102 once the easy-open panel 168 is pulled open from the perforated top panel 164. In the illustrated embodiment of FIGS. 3-4, the parallel portion 172 has a width of 7.5 inches and is disposed substantially 2.25 inches from opposite sides of the bottle pack 160. The length of the parallel portion 172 preferably extends across a majority of the top panel 164 to allow easy access to the bottles 102.

The tapered portion 176 extends from the parallel portion 172 and terminates at the semi-circular portion 180. In the illustrated embodiment of FIGS. 3-4, the tapered portion 176 begins at a distance of about 4.75 inches from the semi-circular portion 180. Opposite sides of the tapered portion 176 each approach the midline of the easy-open panel 168 by a distance of substantially 3.75 inches before terminating at the semi-circular portion 180. As will be recognized, the tapered portion 176 includes a single tapered portion, unlike the three tapered portions comprising the tapered portion 128 of FIG. 2. It should be understood, therefore, that any number of tapered portions may be incorporated into other embodiments of the easy-open panels 128, 168, as is found to be advantageous, and without limitation.

FIG. 5 illustrates an exemplary embodiment of a shrink-wrapped bottle pack 200 that comprises a multiplicity of bottles 102 and includes a perforated top panel 204 according to the present disclosure. As mentioned hereinabove, the bottles 102 may be of a variety typically used for storing liquid contents, such as water, juice, carbonated contents, and the like. The perforated top panel 204 is similar to the perforated top panel 164 of FIGS. 3-4, with the exception that the perforated top panel 204 includes a first tapered portion 208 and a second tapered portion 212 that are configured to allow a practitioner to easily access the bottles 102 comprising the bottle pack 200.

The perforated top panel 204 comprises an easy-open panel 216 that is partially bordered by an alternating series of cuts 112 and lands 116. The series of cuts 112 and lands 116 are configured to allow the easy-open panel 216 to tear away from the top panel 204 upon being pulled by the practitioner. In some embodiments, each of the cuts 112 may have a length of substantially 0.125 inches, and each of the lands 116 may have a length of substantially 0.3125 inches. As mentioned hereinabove, however, in some embodiments, each of the lands 116 may range between substantially 0.250 inches and substantially 0.375 inches, without limitation.

The easy-open panel 216 comprises a parallel portion 220 that extends from the second tapered portion 212 to the first tapered portion 208, which terminates at a semi-circular portion 224. As will be appreciated, a practitioner desiring access to the bottles 102 may grasp the semi-circular portion 224 and pull to separate the first tapered portion 208, the parallel portion 220, and the second tapered portion 212 from the top panel 204 to expose the bottles 102. The semi-circular portion 224 is substantially similar to the semi-circular portion 180 and thus comprises a cutout portion of the top panel 204 having a radius of substantially 0.53 inches. Further, the semi-circular portion 224 may be disposed roughly 1.5 inches from a side portion of the bottle pack 200 and centrally disposed along a midline of the easy-open panel 216.

With continuing reference to FIG. 5, the parallel portion 220 is bordered on opposite sides by parallel perforations. The parallel portion 220 may have any width and length suitable to enable a practitioner to access the bottles 102 once the easy-open panel 216 is pulled open from the perforated top panel 204. Preferably, the length of the parallel portion 220 extends across a majority of the top panel 204 to allow easy access to the bottles 102.

The first tapered portion 208 extends from the parallel portion 220 and terminates at the semi-circular portion 224. Opposite sides of the tapered portion 208 each approach the midline of the easy-open panel 216 before terminating at the semi-circular portion 224. As will be recognized, the first tapered portion 208 includes a single tapered portion, unlike the three tapered portions comprising the tapered portion 128 of FIG. 2. It should be understood, therefore, that any number of tapered portions may be incorporated into other embodiments of the easy-open panel 216, as is found to be advantageous, and without limitation.

The second tapered portion 212 extends from the parallel portion 220 to a side portion of the bottle pack 200. The second tapered portion 212 includes opposite sides 228 that extend to corners 232 of the side portion of the pack 200. As such, bottles 102 packaged at the corners 232 of the bottle pack 200 become accessible when a practitioner separates the first tapered portion 208, the parallel portion 220, and the second tapered portion 212 from the top panel 204 to expose the bottles 102. As mentioned hereinabove with respect to the first tapered portion 208, although the illustrate embodiment of the second tapered portion 212 includes a single tapered portion, in other embodiments, the second tapered portion 212 may include any number of tapered portions, as is found to be advantageous, and without limitation.

FIG. 6 illustrates an exemplary embodiment of a shrink-wrapped bottle pack 240 that comprises a multiplicity of bottles 102 and includes a perforated top panel 244 according to the present disclosure. As mentioned hereinabove, the bottles 102 may be of a variety typically used for storing liquid contents, such as water, juice, carbonated contents, and the like. The perforated top panel 244 includes a first parallel portion 248 and a second parallel portion 252 that are configured to allow a practitioner to easily access the bottles 102 within the bottle pack 240.

The perforated top panel 244 comprises an easy-open panel 256 that is partially bordered by an alternating series of cuts 112 and lands 116. The series of cuts 112 and lands 116 are configured to allow the easy-open panel 256 to tear away from the top panel 244 upon being pulled by the practitioner. As described herein, in some embodiments, each of the cuts 112 may have a length of substantially 0.125 inches, and each of the lands 116 may have a length of substantially 0.3125 inches. Further, in some embodiments, each of the lands 116 may range between substantially 0.250 inches and substantially 0.375 inches, without limitation.

The first and second parallel portions 248, 252 comprising the easy-open panel 256 share a central perforation line 260 that is aligned along a midline of the bottle pack 240. Further, a semi-circular portion 264 may be disposed at a midpoint of the central perforation line 260. The semi-circular portion 224 may be substantially similar to the semi-circular portion 224 and thus may comprise a cutout portion of the top panel 244. As such, a practitioner desiring access to the bottles 102 may use the semi-circular portion 264 to separate the first and second parallel portions 248, 252 along the central perforation line 260 and then pull to separate the first and second parallel portion 248, 252 from the top panel 244 to expose the bottles 102.

As shown in FIG. 6, the first and second parallel portions 248, 252 are bordered on opposite sides by parallel side perforation lines 268. The first and second parallel portions 248, 252 may have any width and length suitable to enable a practitioner to access the bottles 102 once the easy-open panel 256 is pulled open from the perforated top panel 244. In the illustrated embodiment of FIG. 6, the side perforation lines 268 are disposed along the sides of the bottle pack 240 so as to expose a majority of the bottles 102 once the easy-open panel 256 is pulled from the top panel 244. Further, the lengths of the first and second parallel portions 248, 252 preferably extend across a majority of the top panel 244. Moreover, in some embodiments, the parallel portions 248, 252 may include tapered portions that extend into corners 232 of the bottle pack 240. It is contemplated that the tapered portions serve to expose a relatively greater number of the bottles 102 upon the bottle pack 240 being opened, as described herein.

FIG. 7 illustrates an exemplary embodiment of a shrink-wrapped bottle pack 280 that comprises a multiplicity of bottles 102 and includes a perforated top panel 284 according to the present disclosure. As mentioned hereinabove, the bottles 102 may be of a variety typically used for storing liquid contents, such as water, juice, carbonated contents, and the like. The perforated top panel 284 is similar to the perforated top panel 204 of FIG. 5, with the exception that the perforated top panel 284 includes a tapered portion 288 and a parallel portion 292 that are configured to allow a practitioner to easily access the bottles 102 comprising the bottle pack 280.

The perforated top panel 284 comprises an easy-open panel 296 that is partially bordered by an alternating series of cuts 112 and lands 116. The series of cuts 112 and lands 116 are configured to allow the easy-open panel 296 to tear away from the top panel 284 upon being pulled by the practitioner. In some embodiments, each of the cuts 112 may have a length of substantially 0.125 inches, and each of the lands 116 may have a length of substantially 0.3125 inches. As mentioned hereinabove, however, in some embodiments, each of the lands 116 may range between substantially 0.250 inches and substantially 0.375 inches, without limitation.

The parallel portion 292 extends along the length of the perforated top panel 284 to the tapered portion 288, which terminates at a semi-circular portion 300. As will be appreciated, a practitioner desiring access to the bottles 102 may grasp the semi-circular portion 300 and pull to separate the tapered portion 288 and the parallel portion 292 from the top panel 284 to expose the bottles 102. The semi-circular portion 300 is substantially similar to the semi-circular portion 224 and thus may comprise a cutout portion of the top panel 284 having a radius of substantially 0.53 inches. The parallel portion 292 is bordered on opposite sides by parallel perforations 304 that are substantially aligned with shoulders 308 of the bottles 102. As described herein, the parallel portion 292 may have any width and length suitable to enable a practitioner to access the bottles 102 once the easy-open panel 296 is pulled open from the perforated top panel 284.

The tapered portion 288 extends from the parallel portion 292 and terminates at the semi-circular portion 300. Opposite sides of the tapered portion 288 approach the midline of the easy-open panel 296 before terminating at the semi-circular portion 300. As will be recognized, the tapered portion 288 includes a single tapered portion, unlike the three tapered portions comprising the tapered portion 128 of FIG. 2. It is contemplated, however, that any number of tapered portions may be incorporated into other embodiments of the easy-open panel 296, as is found to be advantageous, and without limitation.

Figure 8:
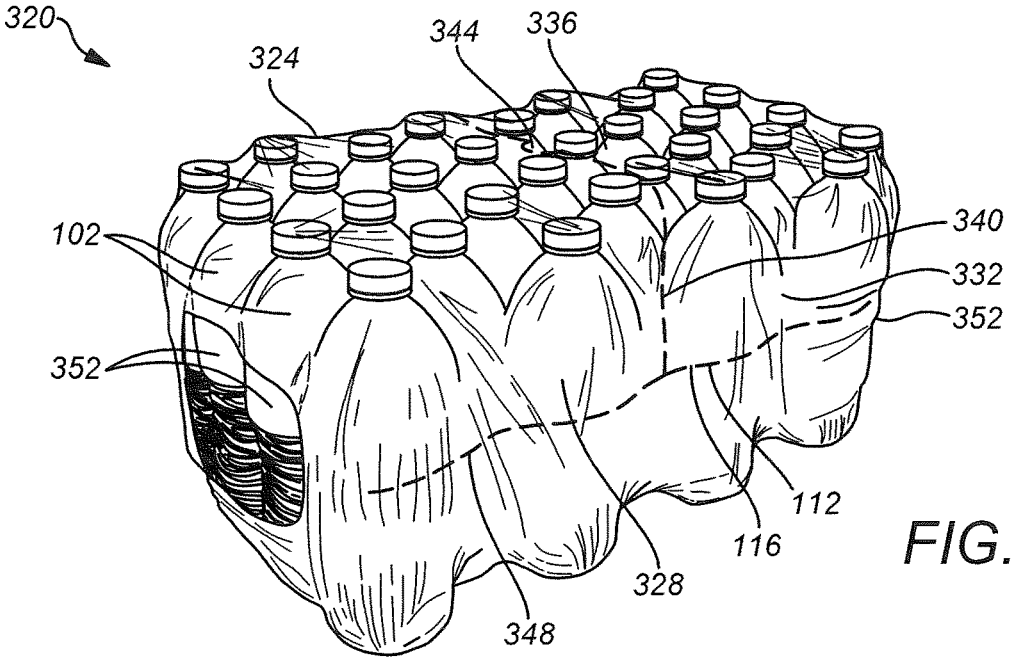
FIG. 8 illustrates a perspective view of an exemplary embodiment of a shrink-wrapped bottle pack that includes a perforated top panel extending to sidewalls of the bottles in accordance with the present disclosure.

FIG. 8 illustrates an exemplary embodiment of a shrink-wrapped bottle pack 320 that comprises a multiplicity of bottles 102 and includes a perforated top panel 324 according to the present disclosure. As mentioned hereinabove, the bottles 102 may be of a variety typically used for storing liquid contents, such as water, juice, carbonated contents, and the like. The perforated top panel 324 includes a first parallel portion 328 and a second parallel portion 332 that are configured to allow a practitioner to easily access the bottles 102 within the bottle pack 320.

The perforated top panel 324 comprises an easy-open panel 336 that is partially bordered by an alternating series of cuts 112 and lands 116. The series of cuts 112 and lands 116 are configured to allow the easy-open panel 336 to tear away from the top panel 324 upon being pulled by the practitioner. As described herein, in some embodiments, each of the cuts 112 may have a length of substantially 0.125 inches, and each of the lands 116 may have a length of substantially 0.3125 inches. Further, in some embodiments, each of the lands 116 may range between substantially 0.250 inches and substantially 0.375 inches, without limitation.

The first and second parallel portions 328, 332 comprising the easy-open panel 336 share a central perforation line 340 that is aligned along a midline of the bottle pack 320. Further, a semi-circular portion 344 may be disposed at a midpoint of the central perforation line 340. The semi-circular portion 334 may be substantially similar to the semi-circular portion 300, shown in FIG. 7, and thus may comprise a cutout portion of the top panel 324. As such, a practitioner desiring access to the bottles 102 may use the semi-circular portion 344 to separate the first and second parallel portions 328, 332 along the central perforation line 340 and then pull to separate the first and second parallel portion 328, 332 from the top panel 324 to expose the bottles 102.

With continuing reference to FIG. 8, the first and second parallel portions 248, 252 are bordered on opposite sides by parallel side perforation lines 348. The first and second parallel portions 328, 332 may have any width and length suitable to enable a practitioner to access the bottles 102 once the easy-open panel 336 is pulled open from the perforated top panel 324. In the illustrated embodiment of FIG. 8, the side perforation lines 348 are disposed along the sidewalls 352 of the bottles 102 comprising the bottle pack 320 so as to expose a majority of the bottles 102 once the easy-open panel 336 is pulled from the top panel 324. Moreover, the lengths of the first and second parallel portions 328, 332 preferably extend across a majority of the top panel 324 so as to expose a relatively large number of the bottles 102 upon the bottle pack 320 being opened, as described herein.

While the invention has been described in terms of particular variations and illustrative figures, those of ordinary skill in the art will recognize that the invention is not limited to the variations or figures described. In addition, where methods and steps described above indicate certain events occurring in certain order, those of ordinary skill in the art will recognize that the ordering of certain steps may be modified and that such modifications are in accordance with the variations of the invention. Additionally, certain of the steps may be performed concurrently in a parallel process when possible, as well as performed sequentially as described above. To the extent there are variations of the invention, which are within the spirit of the disclosure or equivalent to the inventions found in the claims, it is the intent that this patent will cover those variations as well. Therefore, the present disclosure is to be understood as not limited by the specific embodiments described herein, but only by scope of the appended claims.

What is claimed is:

1. A perforated panel disposed in a shrink-wrapped bottle pack, the panel comprising:

an easy-open panel; and an alternating series of cuts and lands bordering a portion of the easy-open panel, the alternating series of cuts and lands including a first top perforation extending from a top panel of the shrink-wrapped bottle pack to a first side perforation disposed on a first side of the shrink-wrapped bottle pack, and a second top perforation extending from the top panel of the shrink-wrapped bottle pack to a second side perforation disposed on a second, opposite side of the shrink-wrapped bottle pack, wherein the first side perforation is confined to the first side of the shrink-wrapped bottle pack and oriented to intersect the first top perforation on the first side, and the second side perforation is confined to the second side of the shrink-wrapped bottle pack and oriented to intersect the second top perforation on the second side.

2. The perforated panel of claim 1, wherein the easy-open panel includes a first parallel portion and a second parallel portion that share a central perforation line that is aligned along a midline of the shrink-wrapped bottle pack, the central perforation line defined by at least the first top perforation and the second top perforation.

3. The perforated panel of claim 2, wherein a semi-circular portion is disposed at a midpoint of the central perforation line and configured to facilitate separating the first parallel portion and the second parallel portion along the central perforation line.

4. The perforated panel of claim 2, wherein the first parallel portion and the second parallel portion are bordered on opposite sides by the first and second side perforations, the first and second side perforations being parallel to each other.

5. The perforated panel of claim 2, wherein the first parallel portion and the second parallel portion have a width and a length to expose a majority of bottles comprising the shrink-wrapped bottle pack.

6. The perforated panel of claim 1, further comprising a semi-circular portion disposed on the top panel of the bottle pack, the first top perforation extending from the semi-circular portion to the first side perforation, and the second top perforation extending from the semi-circular portion to the second side perforation.

7. The perforated panel of claim 6, wherein the first top perforation terminates at the first side perforation, and the second top perforation terminates at the second side perforation.

8. The perforated panel of claim 1, wherein the first side perforation is perpendicular to the first top perforation on the first side, and the second side perforation is perpendicular to the second top perforation on the second side.

9. The perforated panel of claim 1, wherein the first top perforation and the second top perforation meet at a semi-circular portion disposed on the top panel of the bottle pack.

10. The perforated panel of claim 1, wherein the easy-open panel includes a first portion and a second portion, the first portion partially defined by the first top perforation, the second top perforation, a first portion of the first side perforation, and a first portion of the second side perforation, and the second portion partially defined by the first top perforation, the second top perforation, a second portion of the first side perforation, and a second portion of the second side perforation.

11. The perforated panel of claim 10, wherein the first portion and the second portion are parallel to each other.

12. The perforated panel of claim 10, wherein the alternating series of cuts and lands are configured to border less than an entirety of the first portion, and the alternating series of cuts and lands are configured to border less than an entirety of the second portion.

13. The perforated panel of claim 10, further comprising a semi-circular portion disposed on the top panel of the bottle pack, the first top perforation extending from the semi-circular portion to the first side perforation, and the second top perforation extending from the semi-circular portion to the second side perforation.

14. The perforated panel of claim 13, wherein the semi-circular portion is disposed between the first portion and the second portion of the easy-open panel.

15. The perforated panel of claim 1, wherein the first top perforation and the second top perforation together define a central perforation disposed on the top panel of the shrink-wrapped bottle pack.

16. The perforated panel of claim 1, wherein the first and second side perforations are parallel to each other.

17. The perforated panel of claim 1, wherein the first top perforation terminates on the first side, and the second top perforation terminates on the second side.

18. The perforated panel of claim 1, wherein the easy-open panel includes a first portion and a second portion that share a central perforation line defined by the first top perforation and the second top perforation.

19. The perforated panel of claim 1, further comprising:

a third side of the shrink-wrapped bottle pack opposite a fourth side of the shrink-wrapped bottle pack;

a first aperture extending through the shrink-wrapped bottle pack, the first aperture positioned on the third side; and a second aperture extending through the shrink-wrapped bottle pack, the second aperture positioned on the fourth side.

* * * * *